US005678690A

United States Patent [19]

Belvederi et al.

[11] Patent Number: 5,678,690

[45] Date of Patent: Oct. 21, 1997

[54] RIGID HINGED-LID PACKET FOR ELONGATED ELEMENTS, PARTICULARLY CIGARETTES

[75] Inventors: Bruno Belvederi, S. Martino di Monte S. Pietro; Marco Brizzi, Zola Predosa, both of Italy

[73] Assignee: G.D Societa' Per Azioni, Bologna, Italy

[21] Appl. No.: 527,834

[22] Filed: Sep. 13, 1995

[30] Foreign Application Priority Data

Sep. 21, 1994 [IT] Italy ..... B094A0413

[51] Int. Cl.[6] ..... B65D 85/10

[52] U.S. Cl. ..... 206/443; 206/268; 206/273; 229/160.1; 229/227

[58] Field of Search ..... 206/265, 268, 206/271, 273, 443; 229/160.1, 226, 227

[56] References Cited

U.S. PATENT DOCUMENTS

| | | | |
|---|---|---|---|
| 3,469,767 | 9/1969 | Meyers | 229/226 |
| 3,680,767 | 8/1972 | De Lorenzo et al. | 229/26 |
| 4,271,964 | 6/1981 | Train | 229/227 |
| 4,303,191 | 12/1981 | Foster et al. | 229/160.1 |
| 4,948,038 | 8/1990 | Moeller | 206/273 |
| 5,024,376 | 6/1991 | Focke | 229/160.1 |
| 5,092,516 | 3/1992 | Kastanek | 229/226 |

FOREIGN PATENT DOCUMENTS

| | | |
|---|---|---|
| 0086985 | 3/1959 | Denmark . |

*Primary Examiner*—Jimmy G. Foster

*Attorney, Agent, or Firm*—Marshall, O'Toole, Gerstein, Murray & Borun

[57] ABSTRACT

A rigid, hinged-lid packet for elongated elements, particularly cigarettes, presenting a cup-shaped container; a cup-shaped lid hinged to the rear end edge of the container to close the open end of the container; and a collar projecting outwards from the open end of the container; the lid presents a front wall in turn presenting an inner reinforcing tab, one portion of which is gummed to a portion of the collar; and one of the above two portions is torn off.

15 Claims, 3 Drawing Sheets

RIGID HINGED-LID PACKET FOR ELONGATED ELEMENTS, PARTICULARLY CIGARETTES

BACKGROUND OF THE INVENTION

The present invention relates to a rigid hinged-lid packet for elongated elements, particularly cigarettes.

The cigarettes off a manufacturing machine are normally conditioned into packets, each for receiving a respective group of cigarettes, and each comprising a bottom cup-shaped container, and a top cup-shaped lid hinged to a top edge of the bottom container so as to rotate between an open and a closed position.

Known packets of the above type generally present a collar fitted integrally to the inner surface of the bottom container, and projecting outwards from the bottom container to engage the lid when this is closed.

Known packets of the above type are normally formed from respective blanks on a cigarette packing machine wherein a succession of preformed groups of cigarettes, normally enclosed in respective foil wrappings, are fitted with respective U-folded collars before being fed on to a wrapping wheel on which the blanks are folded about the respective groups to form respective packets.

The packets so formed are then fed to a cellophaning machine on which each is wrapped in a sealed outer wrapping made of transparent plastic material and normally presenting a tear-off strip.

Formation of the outer wrapping involves a number of relatively complex, high-cost operations, and the plastic material of which the wrapping is normally made is a serious source of pollution if disposed of carelessly.

SUMMARY OF THE INVENTION

It is an object of the present invention to provide a rigid, hinged-lid packet enabling elimination of the outer wrapping while at the same time protecting the content of the packet.

Since, in the absence of the outer wrapping, the content of the packet would be freely accessible to other than the end user, it is a further object of the present invention to provide a packet which, once opened, clearly indicates to the end user that it has been tampered with.

According to the present invention, there is provided a rigid, hinged-lid packet for elongated elements, particularly cigarettes, the packet comprising a cup-shaped container presenting an open end; a cup-shaped lid hinged to the rear edge of said open end, and presenting a front wall in turn presenting an inner reinforcing tab at least partly integral with a corresponding portion of the front wall of the lid; and a collar projecting outwards from said open end; characterized in that it also comprises removable sealing means for removably connecting the inner tab to the collar.

Preferably, the inner reinforcing tab of the above packet presents a first portion, and the collar presents a second portion facing and gummed to the first portion; one of said two portions defining said removable sealing means, and preferably being at least partly torn off.

Preferably, said tear-off portion is defined at least partly by at least one preformed tear line.

BRIEF DESCRIPTION OF THE DRAWINGS

A number of non-limiting embodiments of the present invention will be described by way of example with reference to the accompanying drawings, in which.

DETAILED DESCRIPTION OF THE INVENTION

Figure 2:
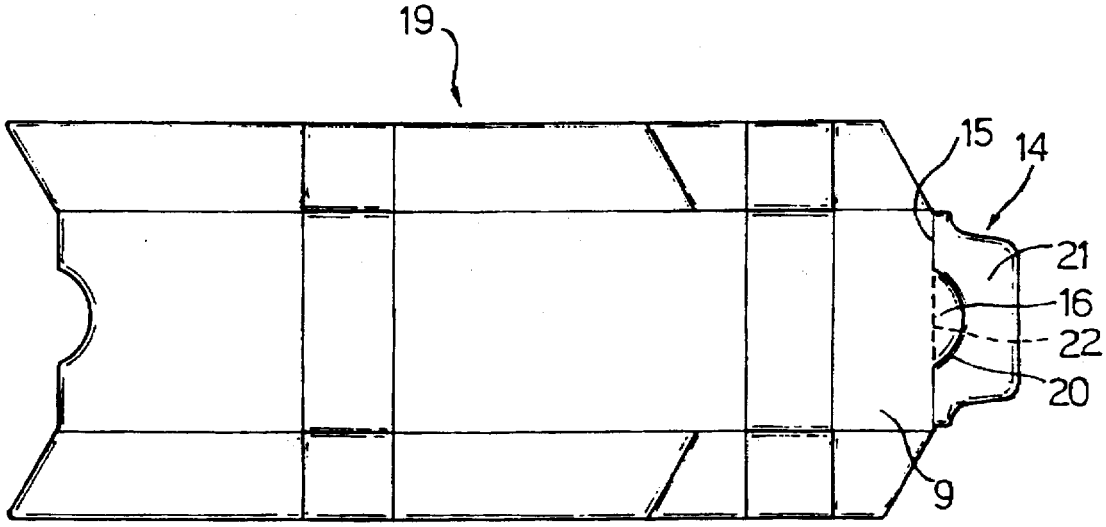
FIG. 2 shows a spread-out view of the blank of the FIG. 1 packet.
Figure 1:
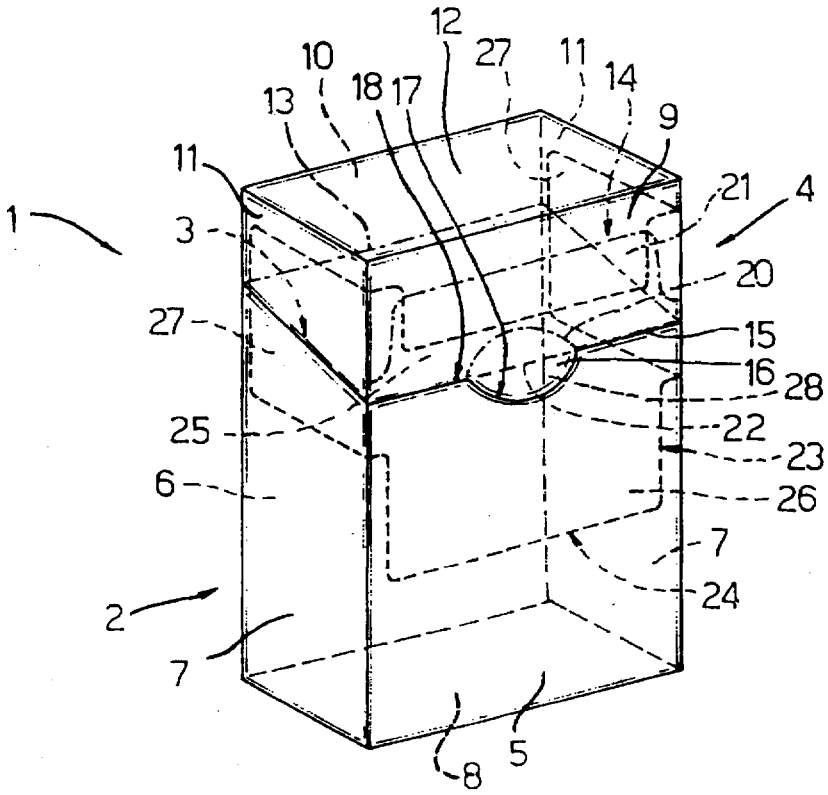
FIG. 1 shows a view in perspective of a first preferred embodiment of the packet according to the present invention.

With reference to FIGS. 1 and 2, number 1 indicates a rigid packet for housing a group (not shown) of cigarettes, and comprising a cup-shaped bottom container 2 presenting an open top end 3; and a cup-shaped top lid 4 hinged to container 2 so as to rotate between two positions respectively closing and opening end 3.

Container 2 presents a front wall 5 and a rear wall 6 parallel to and facing each other; two parallel lateral walls 7 perpendicular to walls 5 and 6; and a bottom wall 8 perpendicular to walls 5, 6 and 7.

Lid 4 presents a front wall 9 and a rear wall 10 parallel to and facing each other; two parallel lateral walls 11 perpendicular to walls 9 and 10; and a top wall 12 perpendicular to walls 9, 10 and 11. More specifically, the free bottom edge of wall 10 is integral with the free top edge of wall 6 along a preformed bend line defining a hinge 13 about which lid 4 is rotated between said closed and open positions.

Lid 4 also comprises a front inner reinforcing tab 14 which is integral with the free bottom edge of wall 9 along a preformed bend line 15 extending along said free edge of wall 9 and parallel to hinge 13, and is folded in a U about line 15 on to the inner surface of wall 9. Finally, lid 4 also comprises a tongue 16 coplanar with wall 9, and extending from line 15 towards container 2 to engage a seat or recess 17 formed in, and extending from the free top edge 18 of, wall 5.

As shown in FIG. 2, tab 14 is the end tab of a substantially rectangular blank 19, and tongue 16 is formed by cutting tab 14 along a semicircular line 20 with its opposite ends along line 15. More specifically, line 20 divides tab 14 into a fixed first portion 21 connected to the inner surface of wall 9, and a removable second portion defined by tongue 16, extending from line 15, and substantially coplanar with first portion 21. The intermediate portion of line 15 between the opposite ends of line 20 is defined by a preformed tear line 22 by which to tear tongue 16 off portion 21.

Packet 1 also comprises a U-shaped collar 23 projecting partly outwards of end 3, and comprising a central wall 24 in turn comprising a top portion 25 projecting beyond edge 18 of wall 5, and a bottom portion 26 connected integral with the inner surface of wall 5. Collar 23 also comprises two lateral walls 27 connected to the inner surface of respective walls 7 from which they project partly towards lid 4. Portion 26 of wall 24 comprises a gummed portion 28 located at recess 17 in wall 5, for enabling connection of tongue 16 to collar 23 and, hence, securing lid 4 to container 2 in the closed position.

Packet 1 is opened by tearing tongue 16 from portion 21 of tab 14 along line 22. Once torn, tongue 16 remains attached to portion 28 of collar 23, thus indicating packet 1 has been tampered with.

FIGS. 3 to 6 show four packets 29–32 very similar to packet 1, and the corresponding component parts of which are indicated, where possible, using the same numbering system as for packet 1.

Figure 3A:
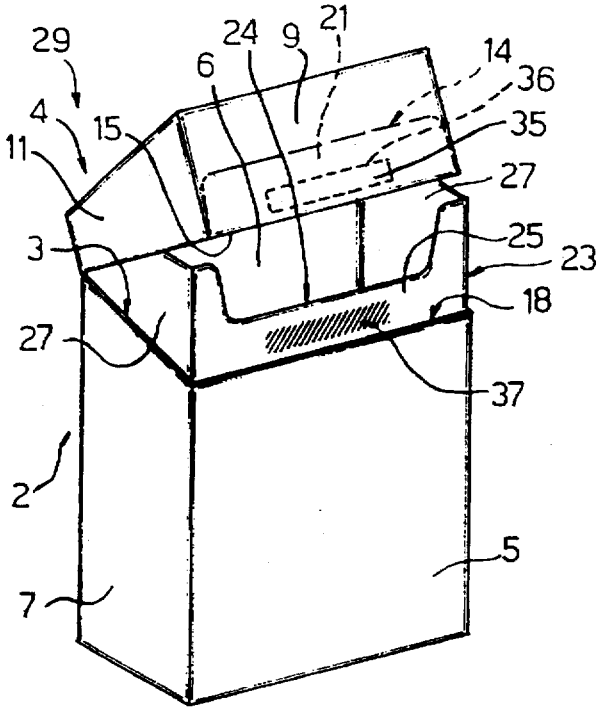
FIG. 3*a* shows a view in perspective of a second preferred embodiment of the packet according to the present invention.
Figure 3B:
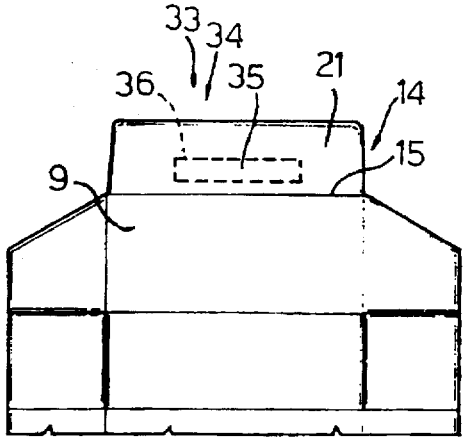
FIG. 3*b* shows a spread-out detail of the blank of the FIG. 3*a* packet.
Figure 4:
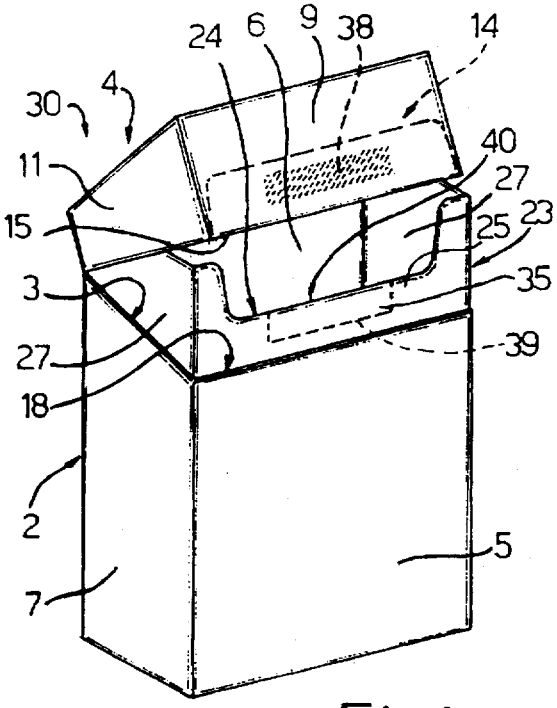
FIGS. 4 and 5 show respective views in perspective of a third and fourth preferred embodiment of the packet according to the present invention.
Figure 5:
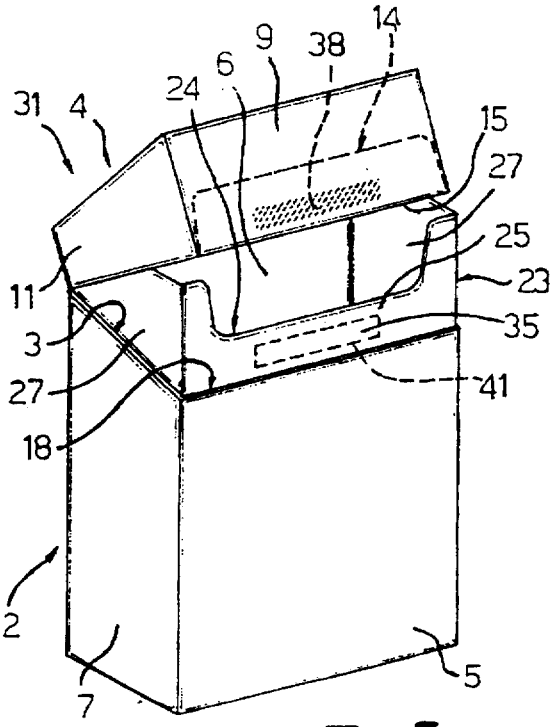

Packet 29 is formed from a blank 33, of which FIG. 3*b* shows only the end portion 34. Blank 33 differs from blank 19, firstly, by the removable portion of reinforcing tab 14 of wall 9 of lid 4 not being located outside portion 21, but being defined by a piece 35 formed centrally in portion 21 and defined by an annular, substantially rectangular, preformed tear line 36; and, secondly, by wall 5 being defined at its free end by a straight edge 18 with no recess 17, thus enabling blanks 33 to be formed easily from a strip with no wastage.

When packet 29 is first opened, piece 35 is torn along line 36, and remains integral with a gummed portion 37 formed on portion 25 of wall 24 of collar 23.

Packets 30 and 31 are similar to each other, and differ from packet 29 by piece 35 being formed, not on reinforcing tab 14, but directly on portion 25 of wall 24 of collar 23, and facing a gummed portion 38 on the inner surface of tab 14. Piece 35 of packet 30 is defined by a substantially C-shaped, preformed tear line 39, and by the top edge 40 of wall 24 of collar 23, whereas piece 35 of packet 31 is formed in a central portion of top portion 25 of wall 24 of collar 23, and is defined by an annular, substantially rectangular, preformed tear line 41.

Figure 6A:
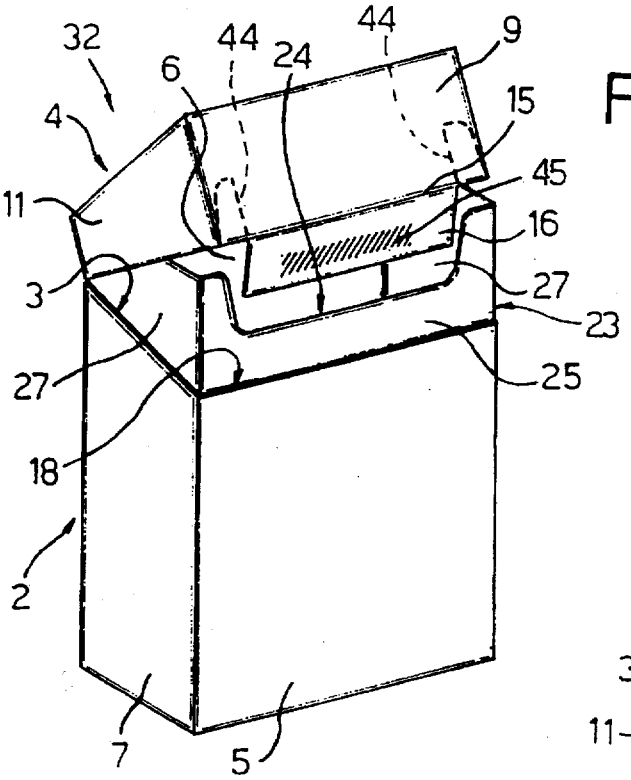
FIGS. 6*a* and 6*b* show views in perspective of a fifth preferred embodiment of the packet according to the present invention in two different positions.
Figure 6B:
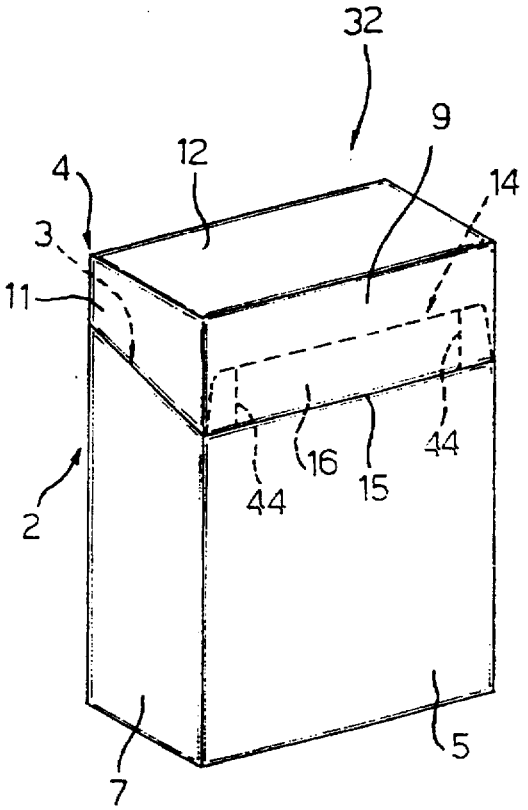
Figure 6C:
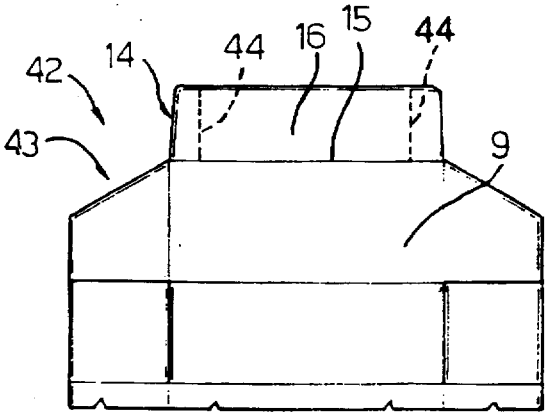
FIG. 6*c* shows a spread-out detail of the blank of the FIGS. 6*a*, 6*b* packet.

Finally, packet 32 is formed from a blank 42, of which FIG. 6*c* shows only the end portion 43, and which differs from blank 19 in that tongue 16 constituting the removable portion of reinforcing tab 14 of wall 9 of lid 4 is no longer fully detached from tab 14 when the packet is first opened, but remains integral with it along line 15 by virtue of tongue 16 being defined by a pair of preformed tear lines 44 crosswise to and extending from line 15. Unlike relative portion 21, tongue 16 is not integral with the inner surface of wall 9, presents a gummed portion 45 facing collar 23, is rotated about line 15 when lid 4 is opened, and is again folded in a U about line 15 when lid 4 is first closed.

In connection with the above, it should be pointed out that each of packets 1 and 29–32 described above is not only one wherein lid 4 is secured to container 2 in the closed position, and may only be opened by tearing a portion of the packet, thus indicating the packet has been tampered with, but may also be formed from a blank substantially similar to those of standard packets, i.e. from a blank employable on any known packing machine with no substantial alterations to the machine being required.

We claim:

1. A rigid, hinged-lid packet for elongated elements, the packet comprising a cup-shaped container presenting an open end having a rear edge; a cup-shaped lid hinged to said rear edge and having a front wall; and two connecting elements interposed between said container and said lid); a first of said connecting elements being an inner reinforcing tab at least a part of which is fixed to a corresponding part of the front wall of the lid along a preformed bend line and folded onto an inner surface of the front wall of the lid; a second of said connecting elements being a collar projecting outwards from said open end; a portion of each of said two connecting elements being fixed to a corresponding portion of the other of said connecting elements; and one of said two portions of one connecting element being a removable portion at least partially defined by a preformed tear line and thereby connected to said one connecting element in a removable manner so that opening of said packet necessarily involves removal of said removable portion and provides an indication the packet has been tampered with.

2. A packet as claimed in claim 1, wherein said two portions are fixed to each other by gumming.

3. A packet as claimed in claim 1, wherein said removable portion (16) (35)(45) is a portion of said inner reinforcing tab (14).

4. A packet as claimed in claim 3, wherein said removable portion (16) comprises a tongue (16) coplanar with and projecting from the front wall (9) of said lid (4) as of a line (15) about which the inner reinforcing tab (14) is folded, and engaging a seat (17) formed in the front wall (5) of said container (2); said preformed tear line (22) forming part of said fold line (15).

5. A packet as claimed in claim 4, wherein said tongue (16) is formed by cutting the inner reinforcing tab (14) along a curved cutting line (20), the two opposite ends of which are located at opposite ends of said preformed tear line (22).

6. A packet as claimed in claim 3, wherein said removable portion (35) is defined by a piece (35) formed centrally on the inner reinforcing tab (14).

7. A packet as claimed in claim 6, wherein said preformed tear line (36) is of annular, substantially rectangular shape.

8. A packet as claimed in claim 3, wherein said removable portion (45) is a central portion (45) of the inner reinforcing tab (14).

9. A packet as claimed in claim 8, wherein said preformed tear line (44) comprises two segments (44) crosswise to a line (15) about which said inner reinforcing tab (14) is folded.

10. A packet as claimed in claim 9, wherein said removable portion (45) is movable about said fold line (15).

11. A packet as claimed in claim 1, wherein said removable portion (35)(35) is a portion of said collar (23).

12. A packet as claimed in claim 11, wherein said collar is rectangular shaped and wherein said removable portion is defined by a piece formed centrally on said rectangular collar.

13. A packet as claimed in claim 11, wherein said preformed tear line (41) is of annular, substantially rectangular shape.

14. A packet as claimed in claim 11, wherein said preformed tear line (39) is substantially C-shaped with its opposite ends on an end edge (40) of said collar (23).

15. A rigid, hinged-lid packet for elongated elements, the packet comprising a cup-shaped container presenting an open end having a rear edge; a cup-shaped lid hinged to said rear edge and having a front wall; and two connecting elements interposed between said container and said lid; a first of said connecting elements being an inner reinforcing tab at least a part of which is fixed to a corresponding part of the front wall of the lid along a preformed bend line and folded onto an inner surface of the front wall of the lid; a second of said connecting elements being a collar projecting outwards from said open end; a portion of each of said two connecting elements being fixed to a corresponding portion of the other of said connecting elements; and one of said two portions of one connecting element being a removable portion at least partially defined by a preformed tear line aligned with said preformed bend line and thereby connected to said one connecting element in a removable manner so that opening of said packet necessarily involves removal of said removable portion and provides an indication the packet has been tampered with.

* * * * *

UNITED STATES PATENT AND TRADEMARK OFFICE

CERTIFICATE OF CORRECTION

PATENT NO. : 5,678,690

DATED : October 21, 1997

INVENTOR(S) : BRUNO BELVEDERI, ET AL.

It is certified that error appears in the above-identified patent and that said Letters Patent is hereby corrected as shown below:

Please delete the reference characters from all of the claims.

Signed and Sealed this

Thirteenth Day of January, 1998

*Attest:*

*Attesting Officer*

BRUCE LEHMAN

*Commissioner of Patents and Trademarks*